US012378711B2

(12) United States Patent
Tsukada

(10) Patent No.: US 12,378,711 B2
(45) Date of Patent: Aug. 5, 2025

(54) SEWING MANAGEMENT SYSTEM

(71) Applicant: JUKI CORPORATION, Tama (JP)

(72) Inventor: Yutaka Tsukada, Tokyo (JP)

(73) Assignee: JUKI CORPORATION, Tama (JP)

( * ) Notice: Subject to any disclaimer, the term of this patent is extended or adjusted under 35 U.S.C. 154(b) by 0 days.

(21) Appl. No.: 18/509,524

(22) Filed: Nov. 15, 2023

(65) Prior Publication Data

US 2024/0158971 A1 May 16, 2024

(30) Foreign Application Priority Data

Nov. 16, 2022 (JP) ..... 2022-183584

(51) Int. Cl.
*D05B 25/00* (2006.01)
*D05B 19/04* (2006.01)
*D05B 19/12* (2006.01)

(52) U.S. Cl.
CPC ..... *D05B 19/12* (2013.01); *D05B 19/04* (2013.01)

(58) Field of Classification Search
CPC ..... D05B 19/12; D05B 19/04; D05B 25/00; D05B 21/00
See application file for complete search history.

(56) References Cited

U.S. PATENT DOCUMENTS

| | | | | |
|---|---|---|---|---|
| 5,229,949 | A * | 7/1993 | Kondo | D05B 19/00 112/470.01 |
| 6,105,520 | A * | 8/2000 | Frazer | D05B 19/12 112/475.08 |
| 6,925,946 | B1 * | 8/2005 | Kang | D05C 3/02 112/102.5 |
| 2001/0004717 | A1 * | 6/2001 | Zhang | D05C 5/00 700/136 |
| 2003/0140832 | A1 * | 7/2003 | Ton | D05C 5/02 112/475.01 |
| 2021/0232127 | A1 * | 7/2021 | Atsumi | A61B 5/18 |

FOREIGN PATENT DOCUMENTS

| | | | | |
|---|---|---|---|---|
| EP | 3517675 | A1 * | 7/2019 | D05B 19/02 |
| JP | 2016-214511 | A | 12/2016 | |
| WO | WO-2013002600 | A2 * | 1/2013 | A41H 42/00 |
| WO | WO-2013136621 | A1 * | 9/2013 | G06F 17/30 |

* cited by examiner

*Primary Examiner* — Tajash D Patel
(74) *Attorney, Agent, or Firm* — Faegre Drinker Biddle & Reath LLP

(57) ABSTRACT

A sewing management system includes: a plurality of sewing machines that perform pattern sewing with a current pattern, which is a set sewing pattern; and a management device that acquires current pattern information indicating information on the current pattern of the sewing machine, and determines whether the current pattern matches a planned sewing pattern.

10 Claims, 4 Drawing Sheets

SEWING MANAGEMENT SYSTEM

CROSS-REFERENCE TO RELATED APPLICATIONS

The present application claims the benefit of priority of Japanese Patent Application No. 2022-183584, filed on Nov. 16, 2022, the content of which is incorporated herein by reference.

TECHNICAL FIELD

The present invention relates to a sewing management system.

BACKGROUND ART

In the technical field related to sewing machines, a sewing machine management system as disclosed in JP2016-214511A is known.

Incidentally, in a sewing machine in which a plurality of sewing patterns have been downloaded from a host system, human error by an operator may cause sewing with a sewing pattern different from the planned sewing pattern, resulting in defective products.

SUMMARY

An object of the present invention is to prevent sewing with an incorrect sewing pattern in advance.

According to the present invention, there is provided a sewing management system including: a plurality of sewing machines that perform pattern sewing with a current pattern, which is a set sewing pattern; and a management device that acquires current pattern information indicating information on the current pattern of the sewing machine, and determines whether the current pattern matches a planned sewing pattern.

According to an aspect of the present invention, a sewing management system is provided that prevents sewing with an incorrect sewing pattern in advance.

DESCRIPTION OF EMBODIMENTS

Hereinafter, embodiments of the present invention will be described with reference to the drawings, but the present invention is not limited thereto. Configuration elements of the embodiments which will be described hereinafter can be appropriately combined with each other. There is also a case where some configuration elements are not used.

Embodiment

Sewing Management System

Figure 1:
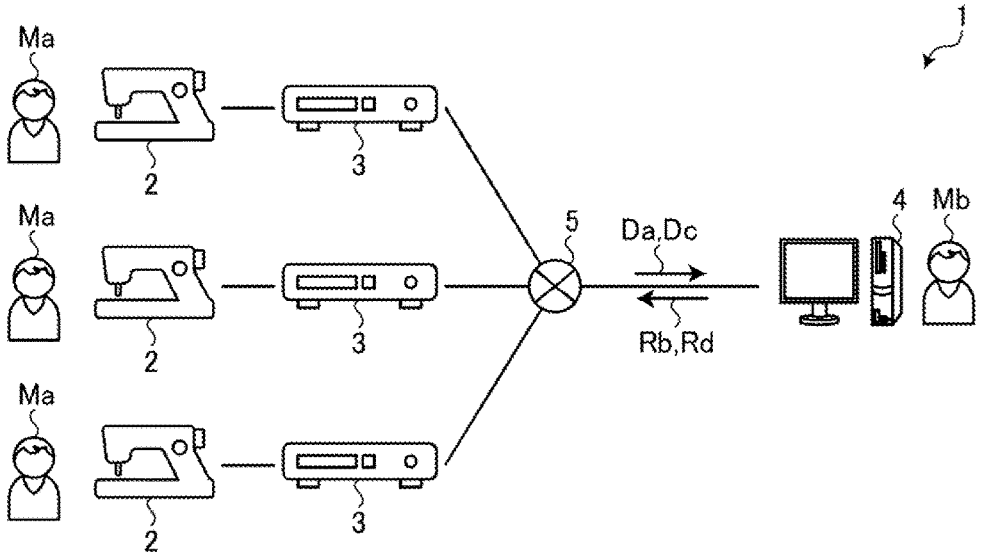
FIG. 1 is a view schematically showing a sewing management system according to the present embodiment.

FIG. 1 is a view schematically showing a sewing management system 1 according to the present embodiment. As shown in FIG. 1, the sewing management system 1 includes a plurality of sewing machines 2, a plurality of gateways 3 corresponding to each sewing machine 2, a management device 4, and a communication network 5. The sewing management system 1 is installed, for example, in a sewing factory, which is an operating facility where a plurality of sewing machines 2 are operated. In the sewing factory, sewn products are manufactured by stitching workpieces with a sewing thread using the sewing machine 2. One or more operators Ma and one or more managers Mb work in the sewing factory. The operator Ma operates the sewing machine 2 to perform sewing processing. The manager Mb manages the operator Ma and the sewing machine 2. The manager Mb operates the management device 4 to grasp and manage the sewing processing status in the sewing factory.

The sewing machine 2 is an industrial sewing machine operated by the operator Ma. Industrial sewing machines include, for example, lockstitch sewing machines that perform lockstitching, cycle sewing machines, actuated feed sewing machines, button sewing machines, and the like. The sewing machine 2 of the present embodiment is a cycle sewing machine that automatically executes pattern sewing based on a predetermined set sewing pattern. The sewing machine 2 starts processing of sewing the predetermined set sewing pattern when the operator Ma performs a predetermined operation while the workpiece and the sewing thread are set in predetermined positions.

The sewing machine 2 is connected via the corresponding gateway 3 to the communication network 5 including short-range wireless communication such as Bluetooth (registered trademark) and a wireless local area network (LAN). The sewing machine 2 transmits operation status information Da and current pattern information Dc to the management device 4 via the gateway 3 and the communication network 5. The sewing machine 2 receives process information, sewing pattern information, current pattern information request Rb, and current pattern change request Rd from the management device 4 via the communication network 5 and the gateway 3.

The process information is information regarding the tasks and schedules to be executed by the sewing machine 2. The process information includes, for example, the type and number of workpieces to be processed by the sewing machine 2, the cloth and thread to be used, the type of sewing pattern of pattern sewing, the order of processing, and the like. The operator Ma performs sewing processing using the sewing machine 2 according to the process information.

The sewing pattern information is shape information of a sewing pattern used by the sewing machine 2 to execute pattern sewing. A storage unit 28 stores sewing pattern information including a plurality of types of sewing patterns transmitted from the management device 4. When a communication device 23 receives new sewing pattern information from the management device 4, the storage unit 28 accumulates and stores the new sewing pattern information.

The operation status information Da is information indicating the operation status of the sewing machine 2. The operation status of the sewing machine 2 includes, for example, operation results of the sewing machine 2 such as power ON/OFF of the sewing machine 2, rotation amount of the motor, thread cutting, start, pause, restart, cancel, and end of sewing. Note that the sewing includes pattern sewing, cycle sewing, continuous sewing, and the like. The operation status of the sewing machine 2 includes information such as the pressing of a volume switch (not shown) that is pressed by the operator Ma when the sewing of the workpiece is completed, the connection status of communication with the gateway 3, errors, and maintenance calls.

The current pattern information Dc is information on the sewing pattern of pattern sewing currently being executed by the sewing machine 2 or the sewing pattern of pattern sewing to be executed when the sewing machine 2 starts sewing processing. That is, the current pattern is a sewing pattern that is set as a sewing pattern to be sewn when the sewing machine 2 is in operation or is to be operated. The operator Ma sets the sewing pattern to be sewn according to the process information as the current pattern.

The current pattern information request Rb is a request transmitted to the sewing machine 2 to transmit the current pattern information Dc, which is information on the current pattern that is the sewing pattern currently set in the sewing machine 2. The current pattern information request Rb is transmitted to the sewing machine 2, for example, at every predetermined cycle set in advance while the sewing machine 2 managed by the sewing management system 1 is in operation. The predetermined cycle is, for example, approximately 10 to 20 seconds.

The current pattern change request Rd is a request transmitted to the sewing machine 2 to change the current pattern to a correct sewing pattern when the current pattern, which is the sewing pattern currently set on the sewing machine 2, does not match the process information.

One gateway 3 is provided for each sewing machine 2. The gateway 3 is disposed on a communication line that connects the sewing machine 2 and the communication network 5. The gateway 3 is a device that relays transmission and reception of various types of data in communication between the sewing machine 2 and the communication network 5, and converts and transfers the protocol of the received data.

The management device 4 is an information terminal operated by the manager Mb to manage the plurality of sewing machines 2 of the sewing management system 1. A typical example of the management device 4 is a desktop personal computer (PC) or a notebook PC, but the management device 4 may also be implemented by a smartphone, a tablet terminal, a mobile phone, a personal digital assistant (PDA), or the like. The management device 4 is installed in an office part of a sewing factory, for example.

The management device 4 is connected to the communication network 5 and can communicate with the plurality of sewing machines 2 via each gateway 3. The management device 4 receives the operation status information Da and the current pattern information Dc from each sewing machine 2 via the communication network 5. The management device 4 transmits the current pattern information request Rb and the current pattern change request Rd to each sewing machine 2 via the communication network 5.

Sewing Machine and Management Device

Figure 2:
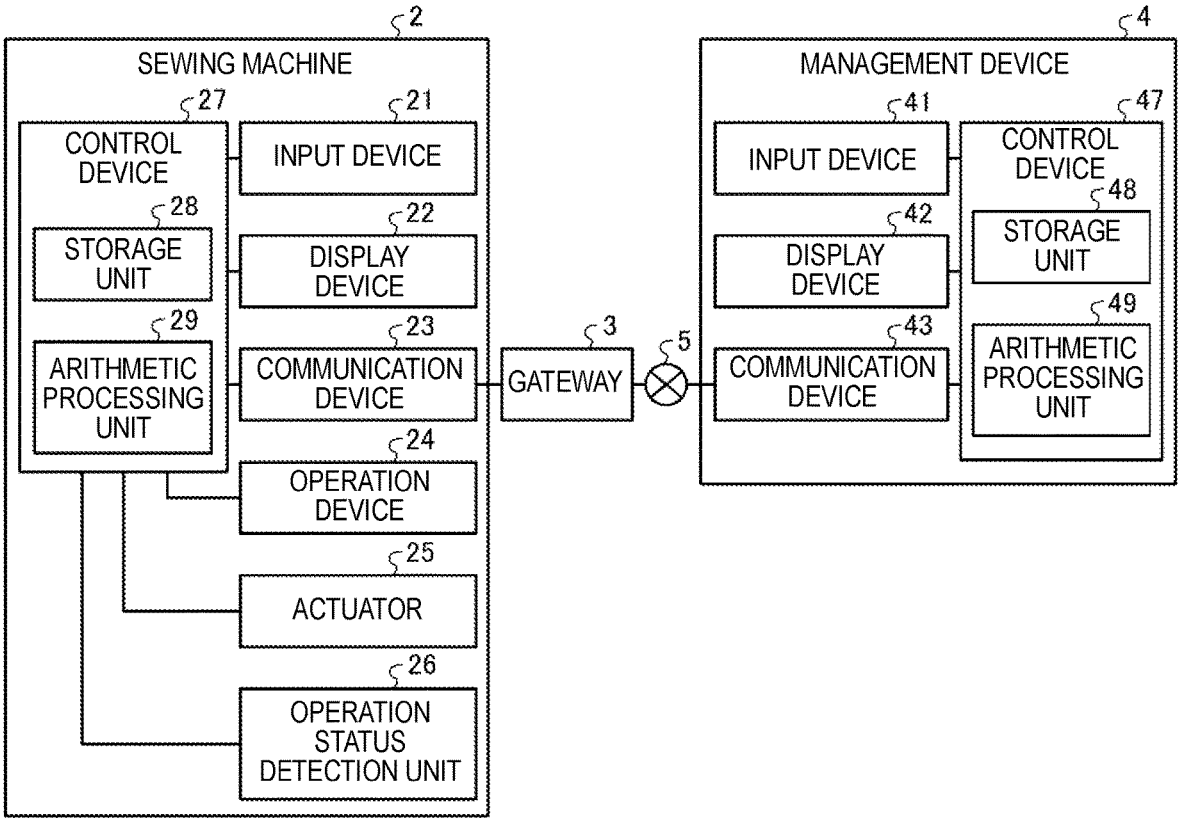
FIG. 2 is a functional block diagram showing a sewing machine and a management device according to the present embodiment.

FIG. 2 is a functional block diagram showing the sewing machine 2 and the management device 4 according to the present embodiment. Although there are a plurality of sewing machines 2 and gateways 3 that can communicate with the management device 4, one set of the sewing machine 2 and the gateway 3 is shown in FIG. 2 for simplicity.

As shown in FIG. 2, the sewing machine 2 includes an input device 21, a display device 22, the communication device 23, an operation device 24, an actuator 25, an operation status detection unit 26, and a control device 27.

The input device 21 receives various input operations by the operator Ma. Input data is generated by operating the input device 21. The input device 21 is, for example, an operation panel including a touch sensor disposed on the display screen of the display device 22. The input device 21 may be implemented by, for example, a keyboard, a mouse, operation keys, a microphone that receives voice input, or the like. The input device 21 is mounted, for example, on the upper surface of a table on which the sewing machine 2 is disposed.

The display device 22 displays various types of information. The display device 22 includes, for example, a flat panel display such as a liquid crystal display (LCD) or an organic electroluminescence display (OELD).

The communication device 23 communicates with the management device 4 via the gateway 3 and the communication network 5. The communication device 23 transmits the operation status information Da and the current pattern information Dc to the management device 4. The communication device 23 receives the current pattern information request Rb and the current pattern change request Rd transmitted from the management device 4.

The operation device 24 receives various operations related to sewing processing from the operator Ma. Operating the operation device 24 causes the sewing machine 2 to operate. The operation device 24 includes, for example, an operation pedal that is disposed below the table and is operated by the leg of the operator Ma. The operation device 24 may include, for example, an operation panel including a touch sensor disposed on the display screen of the display device 22. The sewing machine 2 is operated when the operation device 24 is operated by the operator Ma.

The actuator 25 includes various drive mechanisms and drive sources that operate each part of sewing machine 2. The actuator 25 executes various operations for the sewing machine 2 to sew a predetermined set sewing pattern when the operation device 24 receives a predetermined operation from the operator Ma.

The operation status detection unit 26 detects the operation status of the sewing machine 2. The operation status detection unit 26 is mounted on or connected to the sewing machine 2 and includes various sensors that detect various types of physical information on the sewing machine 2. Note that whether the mode of connection is a wired connection or a wireless connection does not matter. The sensor includes, for example, a drive amount sensor that detects the drive amount of the actuator 25. The drive amount sensor includes, for example, an encoder that detects the rotation amount of the motor, a position sensor that detects the position of a holding member of a sewing machine needle, and the like. The operation status detection unit 26 outputs information on the detected operation status of the sewing machine 2 to the control device 27.

The control device 27 includes a computer system and executes various controls on each part of the sewing machine 2. The control device 27 includes the storage unit 28 and an arithmetic processing unit 29.

The storage unit 28 is a storage device including a primary storage device which is a volatile memory that temporarily stores data such as a random access memory (RAM), and a secondary storage device which is a nonvolatile memory in which various programs and various types of data used by the arithmetic processing unit 29 for calculations are stored such as a read only memory (ROM), a hard disk drive (HDD), a solid state drive (SSD), or a storage. The storage unit 28 stores at least the process information and the sewing pattern information acquired from the management device 4, and the set current pattern information Dc. When the storage unit 28 receives a predetermined operation from the input device 21, the storage unit 28 newly sets or changes the current pattern.

The storage unit 28 stores at least a program for the arithmetic processing unit 29 to execute the transmission of the operation status information Da to the management device 4 at every predetermined cycle set in advance, and a program for the arithmetic processing unit 29 to execute the transmission of the current pattern information Dc to the management device 4 when the communication device 23 receives the current pattern information request Rb.

The arithmetic processing unit 29 is an arithmetic processing device including a processor such as a central processing unit (CPU) or a micro processing unit (MPU). The arithmetic processing unit 29 operates based on programs stored in the storage unit 28 and executes various types of processing. The arithmetic processing unit 29 acquires information output from the input device 21, the communication device 23, the operation device 24, the actuator 25, and the operation status detection unit 26, for example. The arithmetic processing unit 29 outputs, for example, a control signal for causing the display device 22 to display predetermined display data.

The arithmetic processing unit 29 acquires the operation status information Da output from the operation status detection unit 26, for example. The arithmetic processing unit 29 outputs, to the communication device 23, a control signal for transmitting the acquired operation status information Da to the management device 4 at every predetermined cycle set in advance. For example, when the communication device 23 receives the current pattern information request Rb, the arithmetic processing unit 29 acquires the current pattern information Dc stored in the storage unit 28 and outputs, to the communication device 23, a control signal for transmitting the acquired current pattern information Dc to the management device 4. For example, when the communication device 23 receives the current pattern change request Rd, the arithmetic processing unit 29 outputs, to the display device 22, a control signal for displaying a change request message prompting to change the current pattern on the display device 22. Note that the functions of the arithmetic processing unit 29 are not limited to the functions described above, and are assumed to have at least a function for implementing the processing shown in the modification example described later.

The management device 4 includes an input device 41, a display device 42, a communication device 43, and a control device 47.

The input device 41 receives various input operations by the manager Mb. Input data is generated by operating the input device 41. The input device 41 is implemented by, for example, a keyboard, a mouse, operation keys, a microphone that receives voice input, or the like. When the management device 4 is a smartphone or a tablet terminal, the input device 41 may be, for example, an operation panel including a touch sensor disposed on the display screen of the display device 42.

The display device 42 displays various types of information. The display device 42 includes, for example, a flat panel display such as a liquid crystal display or an organic EL display.

The communication device 43 communicates with each sewing machine 2 via the communication network 5. The communication device 43 receives the operation status information Da and the current pattern information Dc transmitted from the management device 4. The communication device 43 transmits the current pattern information request Rb and the current pattern change request Rd to the management device 4.

The control device 47 includes a computer system and executes various controls on each part of the management device 4. The control device 47 includes a storage unit 48 and an arithmetic processing unit 49.

The storage unit 48 is a storage device including a primary storage device which is a volatile memory that temporarily stores data such as a RAM, and a secondary storage device which is a nonvolatile memory in which various programs and various types of data used by the arithmetic processing unit 49 for calculations are stored such as a ROM, an HDD, an SSD, or a storage. The storage unit 48 stores, for example, identification information of each sewing machine 2 included in the sewing management system 1, management information including tasks and schedules of sewing processing executed by each sewing machine 2, and the like.

The storage unit 48 includes at least a program for the arithmetic processing unit 49 to execute the transmission of the current pattern information request Rb to the sewing machine 2 at every predetermined cycle set in advance, a program for the arithmetic processing unit 49 to execute determination on whether the current pattern of each sewing machine 2 matches the planned sewing pattern when the communication device 23 receives the current pattern information Dc, and a program for the arithmetic processing unit 49 to execute the transmission of the current pattern change request Rd to the sewing machine 2 based on the determination result.

The arithmetic processing unit 49 is an arithmetic processing device including a processor such as a CPU. The arithmetic processing unit 49 operates based on programs stored in the storage unit 48 and executes various types of processing. The arithmetic processing unit 49 acquires information output from the input device 41 and the communication device 43, for example. The arithmetic processing unit 49 outputs, for example, a control signal for causing the display device 42 to display predetermined display data.

The arithmetic processing unit 49 outputs, to the communication device 43, a control signal for transmitting the current pattern information request Rb to the sewing machine 2, for example, at every predetermined cycle set in advance. For example, when the communication device 23 receives the current pattern information Dc, the arithmetic processing unit 49 determines whether the current pattern of each sewing machine 2 matches a planned sewing pattern. The planned sewing pattern can be specified, for example, based on the process information transmitted to the sewing machine 2 and the operation results of the operation status information Da periodically transmitted from the sewing machine 2. For example, when the current pattern of each sewing machine 2 does not match the planned sewing pattern, the arithmetic processing unit 49 outputs, to the communication device 43, a control signal for transmitting the current pattern change request Rd to the sewing machine 2. Note that the functions of the arithmetic processing unit 49 are not limited to the functions described above, and are assumed to have at least a function for implementing the processing shown in the modification example described later.

Sewing Management Method

The management device 4 transmits, to each sewing machine 2, the process information indicating information on tasks and schedules to be executed by the sewing machine 2, and the sewing pattern information which is shape information of a sewing pattern by which the sewing machine 2 executes pattern sewing. The timing at which the management device 4 transmits the process information and the sewing pattern information to each sewing machine 2 may be a timing such as the beginning of the day, week, or month when the sewing factory starts operating, or a timing to start production of predetermined sewn products.

The arithmetic processing unit 29 of the sewing machine 2 stores the received process information and the pattern information in the storage unit 28, and displays the message notifying the fact on the display device 22. The arithmetic processing unit 29 displays the process information and the pattern information stored in the storage unit 28 on the display device 22 based on a predetermined operation from the input device 21 by the operator Ma. The operator Ma sets a current pattern according to the process information and performs sewing processing with the sewing machine 2. The sewing machine 2 receives a predetermined start operation by the operator Ma from the operation device 24, and thereby starts sewing processing of performing pattern sewing with the current pattern, which is a set sewing pattern.

While the sewing machine 2 is in operation, the operation status detection unit 26 detects the operation status of the sewing machine 2 and outputs the detected operation status to the arithmetic processing unit 29. Note that the state where the sewing machine 2 is in operation means at least a state where the sewing machine 2 is powered on, and also includes a state where sewing is not performed. The arithmetic processing unit 29 causes the communication device 23 to transmit the acquired operation status information Da to the management device 4 at a predetermined cycle. The management device 4 can grasp the progress of each sewing machine 2 by periodically acquiring the operation status information Da of the sewing machines 2.

Figure 3:
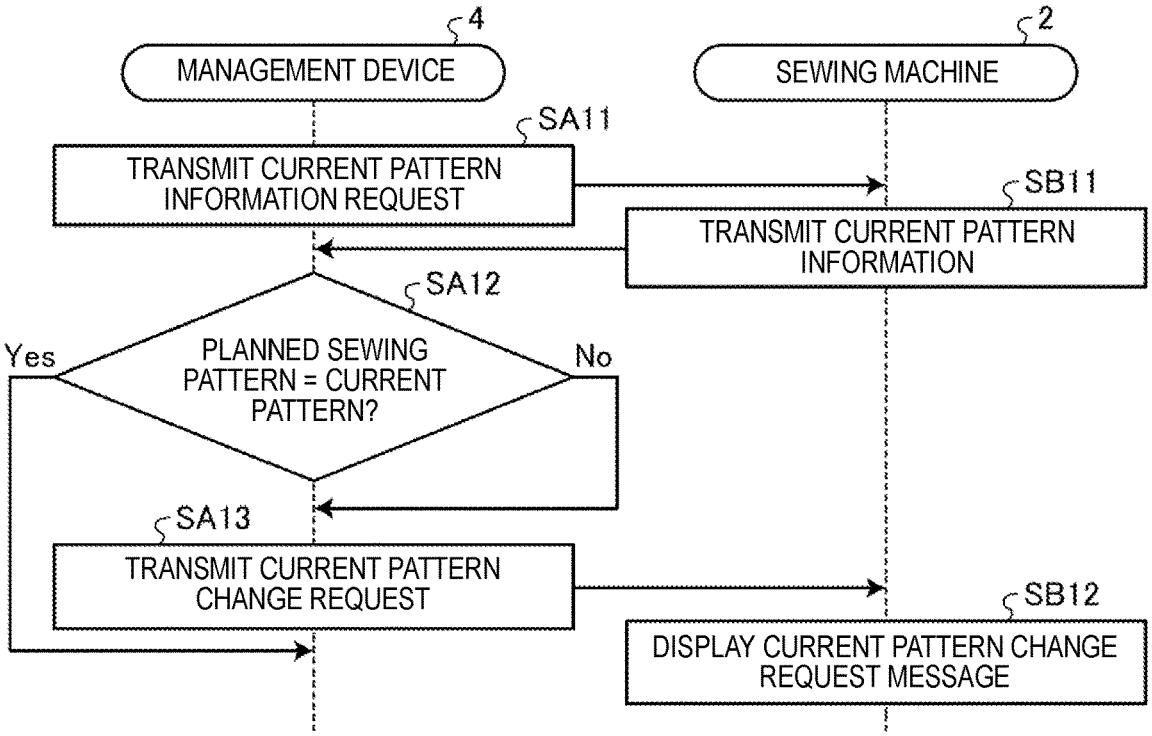
FIG. 3 is a flowchart showing an operation of a sewing management system according to the present embodiment.

FIG. 3 is a flowchart showing an operation of the sewing management system 1 according to the present embodiment. The processing of steps SA11, SA12, and SA13 shown in FIG. 3 is executed by the management device 4 based on the predetermined program and data. The processing of steps SB11 and SB12 is executed by the sewing machine 2 based on the predetermined program and data. The processing of the flowchart shown in FIG. 3 is repeatedly executed at a predetermined cycle while the sewing machine 2 is in operation.

Based on a predetermined cycle, the management device 4 outputs a control signal to the communication device 43 to transmit the current pattern information request Rb to each sewing machine 2. The current pattern information request Rb is transmitted to each sewing machine 2 by the communication device 43 (step SA11).

The communication device 23 of each sewing machine 2 receives the current pattern information request Rb transmitted from the management device 4. The arithmetic processing unit 29 of the sewing machine 2 acquires the current pattern information request Rb received by the communication device 23. The arithmetic processing unit 29 acquires the current pattern information Dc stored in the storage unit 28 according to the current pattern information request Rb. The arithmetic processing unit 29 outputs a control signal to the communication device 23 to transmit the current pattern information Dc to the management device 4. The current pattern information Dc is transmitted to the management device 4 by the communication device 23 (step SB11).

The communication device 43 of the management device 4 receives the current pattern information Dc transmitted from each sewing machine 2. The arithmetic processing unit 49 of the management device 4 acquires the current pattern information Dc corresponding to each sewing machine 2 received by the communication device 43 in association with the identifier of the sewing machine 2. The arithmetic processing unit 49 specifies a planned sewing pattern based on the process information including pattern information of pattern sewing to be executed by the sewing machine 2 and the operation status most recently received from the sewing machine 2. Based on the current pattern information Dc of the sewing machine 2, the arithmetic processing unit 49 determines whether the current pattern matches the planned sewing pattern (step SA12).

When it is determined that the current pattern matches the planned sewing pattern (step SA12; Yes), the arithmetic processing unit 49 ends the series of processing in the flowchart shown in FIG. 4. When it is determined that the current pattern does not match the planned sewing pattern (step SA12; No), the arithmetic processing unit 49 executes step SA13.

The arithmetic processing unit 49 outputs a control signal to the communication device 43 to transmit the current pattern change request Rd for requesting the sewing machine 2, in which the current pattern does not match the planned sewing pattern, to change the current pattern to the planned sewing pattern. The current pattern change request Rd is transmitted to the sewing machine 2 by the communication device 43 (step SA13).

The communication device 23 of the sewing machine 2 receives the current pattern change request Rd transmitted from the management device 4. The arithmetic processing unit 29 of the sewing machine 2 acquires the current pattern change request Rd received by the communication device 23. Based on the current pattern change request Rd, the arithmetic processing unit 29 outputs a control signal to the display device 42 to display the display data of the change request message indicating that the current pattern change is requested on the display device 42. The display device 42 displays the display data of the change request message indicating that the current pattern change is requested on the display screen (step SB12).

Effects

As described above, according to the embodiment, it is possible to acquire the current pattern information Dc indicating information on the current pattern of the sewing machine 2 from the plurality of sewing machines 2 that perform the pattern sewing with the current pattern, which is the set sewing pattern, and determine whether the current pattern matches the planned sewing pattern. Accordingly, it possible to determine whether the pattern sewing is being performed using the correct sewing pattern, and thus it is possible to prevent sewing with an incorrect sewing pattern in advance. For example, even when sewing with an incorrect sewing pattern has already been performed, it is possible to prevent the production of more defective products.

According to the embodiment, the planned sewing pattern can be specified based on the process information including information on the sewing pattern of pattern sewing to be executed by the sewing machine 2, and the operation status information Da indicating the operation status of the sewing machine 2 output by the sewing machine 2 at a predetermined cycle. As a result, even when the sewing machine 2 handles a plurality of types of sewing patterns, it is possible to specify the sewing pattern to be currently sewn, and thus it is possible to determine whether sewing is being performed with the correct sewing pattern.

According to the embodiment, when the current pattern information request Rb for requesting the current pattern information Dc of the sewing machine 2 transmitted from the management device 4 at a predetermined cycle is acquired, the sewing machine 2 transmits the current pattern information Dc to the management device 4. Accordingly, it is possible to determine whether sewing is being performed with the correct sewing pattern each time. When it is determined that the current pattern of the sewing machine 2 is different from the planned sewing pattern, the management device 4 transmits the current pattern change request Rd for requesting the sewing machine 2 to change the current pattern to the planned sewing pattern. The sewing machine 2 displays the message indicating that the current pattern change request Rd is received on the display device 22. Accordingly, the operator Ma of the sewing machine 2 can quickly notice that an incorrect sewing pattern is set as the current pattern.

Modification Example

FIGS. 4 to 7 are flowchart showing other examples of the operation of the sewing management system 1 according to the present embodiment.

First Modification Example

Sewing Management Method

Figure 4:
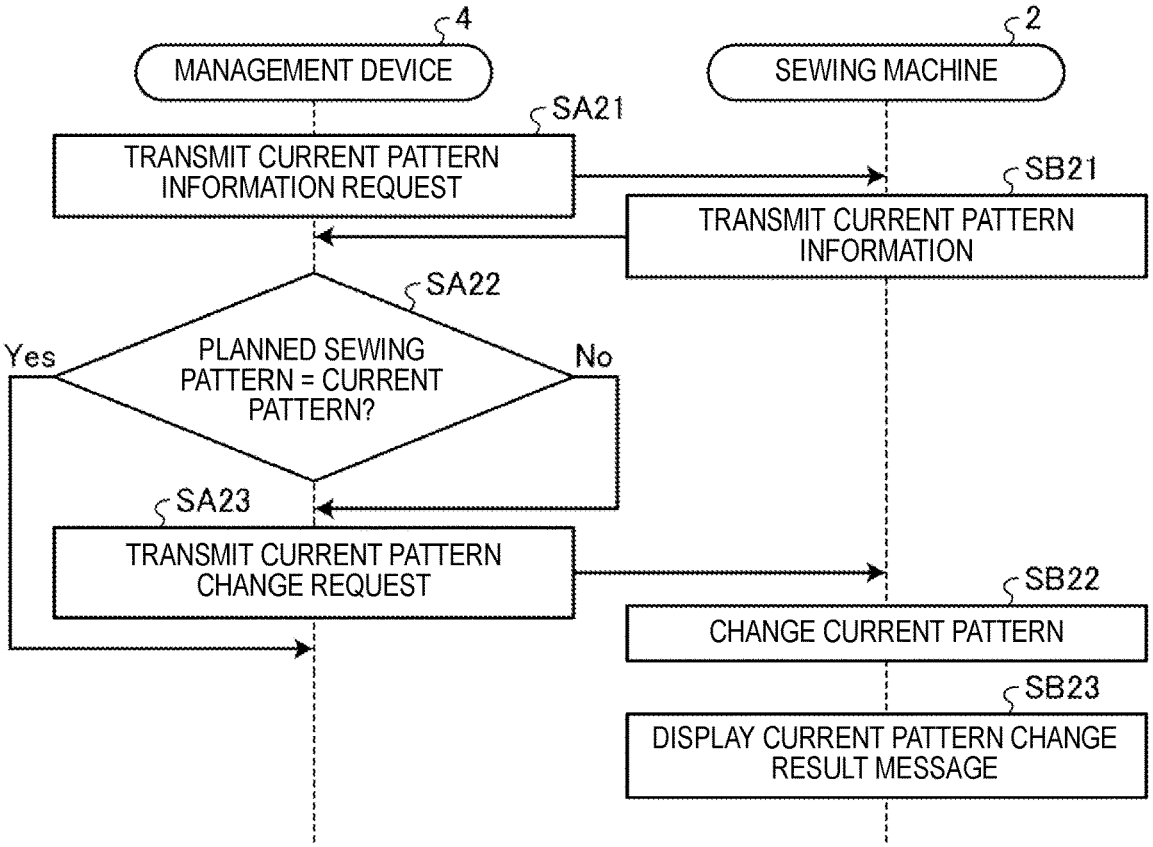
FIG. 4 is a flowchart showing another example of an operation of the sewing management system according to the present embodiment.

Regarding the processing in the flowchart of the first modification example shown in FIG. 4, description of the same processing as the processing in the flowchart of the embodiment shown in FIG. 3 will be omitted as appropriate, and different processing will be described. The processing of steps SA21, SA22, and SA23 shown in FIG. 4 is executed by the management device 4 based on the predetermined program and data. The processing of steps SB21, SB22, and SB23 is executed by the sewing machine 2 based on the predetermined program and data.

The processing of steps SA21, SB21, SA22, and SA23 is the same as the processing of steps SA11, SB11, SA12, and SA13 in the embodiment shown in FIG. 3, and therefore the description thereof will be omitted.

When the current pattern change request Rd is transmitted from the management device 4 (step SA23), the communication device 23 of the sewing machine 2 receives the current pattern change request Rd transmitted from the management device 4. The arithmetic processing unit 29 of the sewing machine 2 acquires the current pattern change request Rd received by the communication device 23. The current pattern change request Rd includes an identifier indicating the planned sewing pattern, or the like. Based on the current pattern change request Rd, the arithmetic processing unit 29 performs processing of changing the current pattern to the planned sewing pattern, and updates the current pattern information Dc stored in the storage unit 28 (step SB22).

The arithmetic processing unit 29 outputs a control signal to the display device 42 to display the display data of the change result message indicating that the current pattern change is executed on the display device 42. The display data may include shape data of the new current pattern. The display device 42 displays the display data of the change result message indicating that the current pattern change is executed on the display screen (step SB23).

Effects

As described above, according to the first modification example, when it is determined that the current pattern of the sewing machine 2 is different from the planned sewing pattern, the management device 4 transmits the current pattern change request Rd for requesting the sewing machine 2 to change the current pattern to the planned sewing pattern. The sewing machine 2 changes the setting of the current pattern according to the current pattern change request Rd, and displays the message indicating that the change is executed on the display device 22. Accordingly, the operator Ma of the sewing machine 2 can quickly notice that an incorrect sewing pattern was set as the current pattern. Since the current pattern is automatically corrected, even when the operator Ma overlooks the message, further sewing with an incorrect sewing pattern can be prevented.

Second Modification Example

Sewing Management Method

Figure 5:
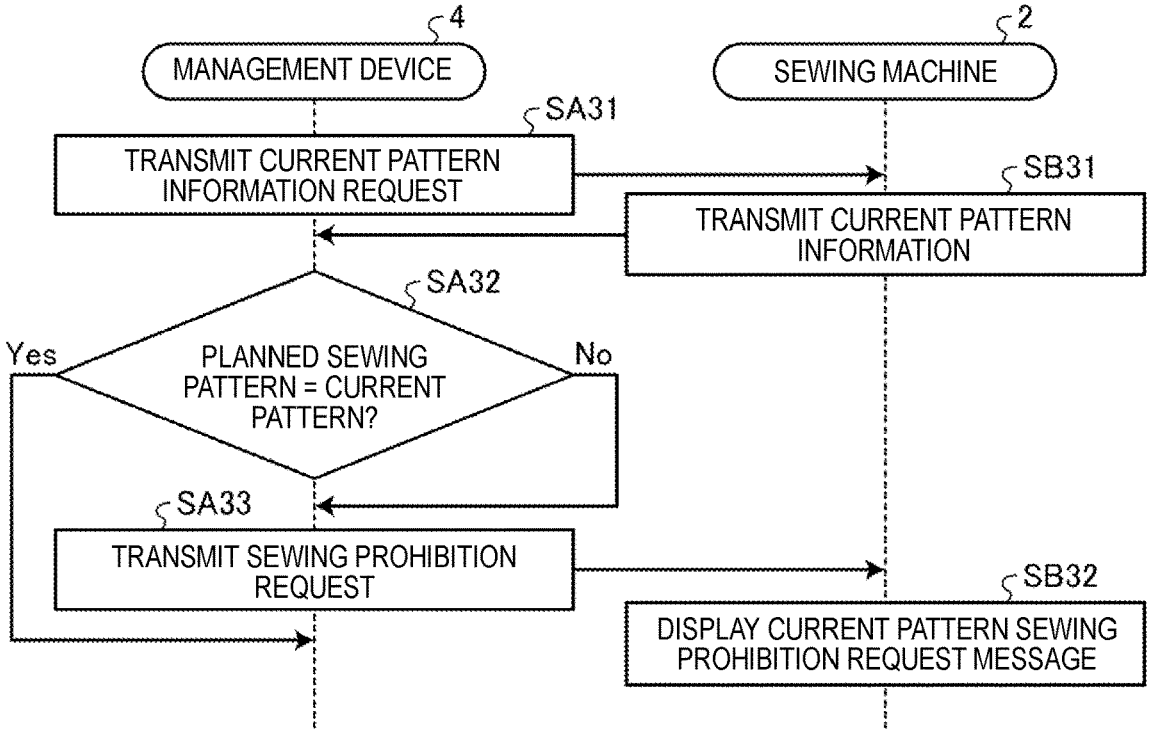
FIG. 5 is a flowchart showing another example of the operation of the sewing management system according to the present embodiment.

Regarding the processing in the flowchart of the second modification example shown in FIG. 5, description of the same processing as the processing in the flowchart of the embodiment shown in FIG. 3 will be omitted as appropriate, and different processing will be described. The processing of steps SA31, SA32, and SA33 shown in FIG. 5 is executed by the management device 4 based on the predetermined program and data. The processing of steps SB31 and SB32 is executed by the sewing machine 2 based on the predetermined program and data.

The processing of steps SA31, SB31, and SA32 is the same as the processing of steps SA11, SB11, and SA12 in the embodiment shown in FIG. 3, and therefore the description thereof will be omitted. When it is determined that the current pattern does not match the planned sewing pattern (step SA32; No), the arithmetic processing unit 49 of the management device 4 executes step SA33.

The arithmetic processing unit 49 outputs a control signal to the communication device 43 to transmit a sewing prohibition request for requesting the sewing machine 2, in which the current pattern does not match the planned sewing pattern, to prohibit the sewing with the current pattern. That is, in the second modification example, a sewing prohibition request is output instead of the current pattern change request Rd of the embodiment. The sewing prohibition request is transmitted to the sewing machine 2 by the communication device 43 (step SA13).

The communication device 23 of the sewing machine 2 receives the sewing prohibition request transmitted from the management device 4. The arithmetic processing unit 29 of the sewing machine 2 acquires the sewing prohibition request received by the communication device 23. Based on the sewing prohibition request, the arithmetic processing unit 29 outputs a control signal to the display device 42 to display the display data of the prohibition request message indicating that the prohibition of the sewing with the current pattern is requested on the display device 42. The display device 42 displays the display data of the prohibition request message indicating that the prohibition of the sewing with the current pattern is requested on the display screen (step SB32).

Effects

As described above, according to the second modification example, when it is determined that the current pattern of the sewing machine 2 is different from the planned sewing pattern, the management device 4 transmits the sewing prohibition request for requesting the sewing machine 2 to prohibit the sewing with the current pattern. The sewing machine 3 displays the message indicating that the sewing prohibition request is received on the display device 22. Accordingly, the operator Ma of the sewing machine 2 can quickly notice that an incorrect sewing pattern is set as the current pattern.

Third Modification Example

Sewing Management Method

Figure 6:
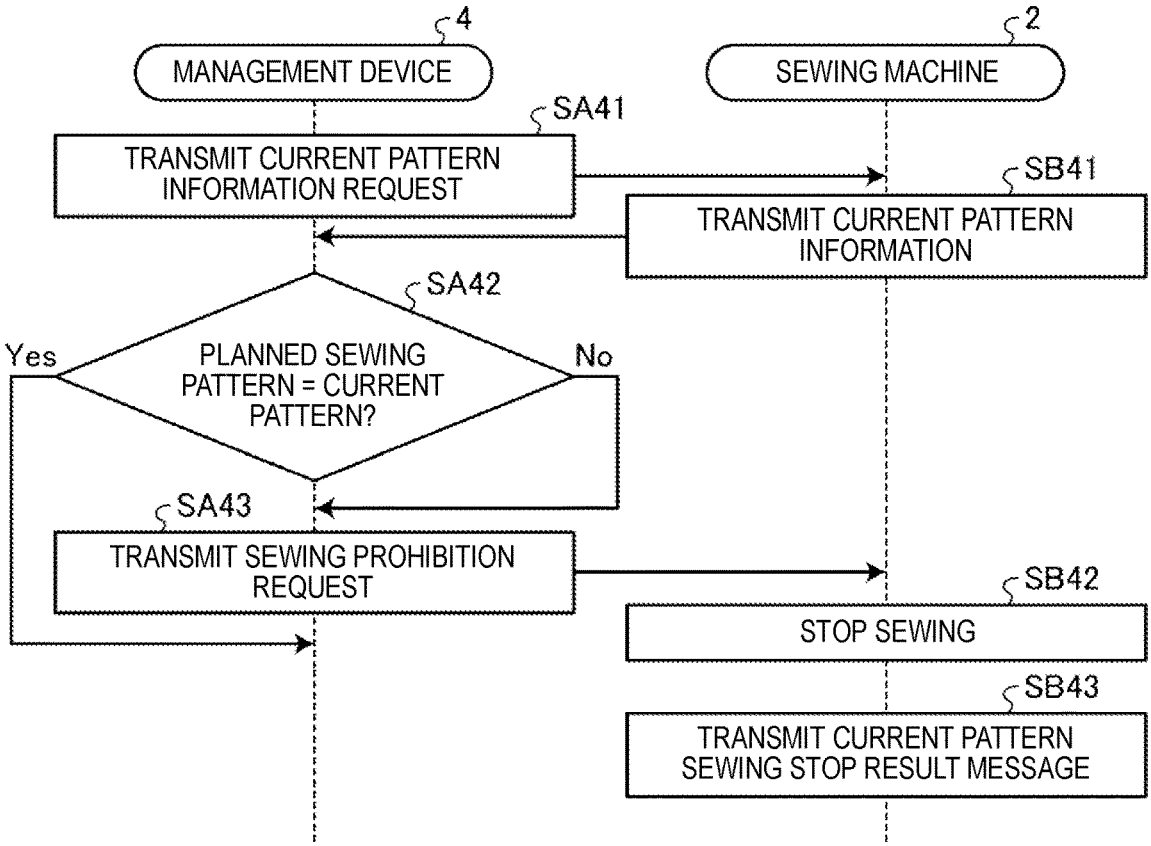
FIG. 6 is a flowchart showing another example of the operation of the sewing management system according to the present embodiment.

Regarding the processing in the flowchart of the third modification example shown in FIG. 6, description of the same processing as the processing in the flowchart of the second modification example shown in FIG. 5 will be omitted as appropriate, and different processing will be described. The processing of steps SA41, SA42, and SA43 shown in FIG. 6 is executed by the management device 4 based on the predetermined program and data. The processing of steps SB41, SB42, and SB43 is executed by the sewing machine 2 based on the predetermined program and data.

The processing of steps SA41, SB41, SA42, and SA43 is the same as the processing of steps SA31, SB31, SA32, and SA33 in the embodiment shown in FIG. 5, and therefore the description thereof will be omitted.

When the sewing prohibition request is transmitted from the management device 4 (step SA43), the communication device 23 of the sewing machine 2 receives the sewing prohibition request transmitted from the management device 4. The arithmetic processing unit 29 of the sewing machine 2 acquires the sewing prohibition request received by the communication device 23. The sewing prohibition request may include an identifier indicating the planned sewing pattern, or the like. Based on the sewing prohibition request, the arithmetic processing unit 29 outputs a control signal to each actuator 25 to stop sewing in the current pattern. The actuator 25 stops sewing (step SB42). Note that, when the sewing processing has not been started, for example, processing may be performed to invalidate the start operation of the operation device 24 by the operator Ma.

The arithmetic processing unit 29 outputs a control signal to the display device 42 to display the display data of the stop result message indicating that the sewing with the current pattern is stopped on the display device 42. The display data may include an identifier and shape data of the planned sewing pattern. The display device 42 displays the display data of the stop result message indicating that the sewing with the current pattern is stopped on the display screen (step SB43).

Effects

As described above, according to the third modification example, when it is determined that the current pattern of the sewing machine 2 is different from the planned sewing pattern, the management device 4 transmits the sewing prohibition request for requesting the sewing machine 2 to prohibit the sewing with the current pattern. The sewing machine 2 stops the sewing with the current pattern according to the sewing prohibition request, and displays the message indicating that the sewing is stopped on the display device 22. Accordingly, the operator Ma of the sewing machine 2 can quickly notice that an incorrect sewing pattern was set as the current pattern. Since the sewing processing is automatically stopped and corrected, even when the operator Ma overlooks the message, further sewing with an incorrect sewing pattern can be prevented.

Fourth Modification Example

Sewing Management Method

Figure 7:
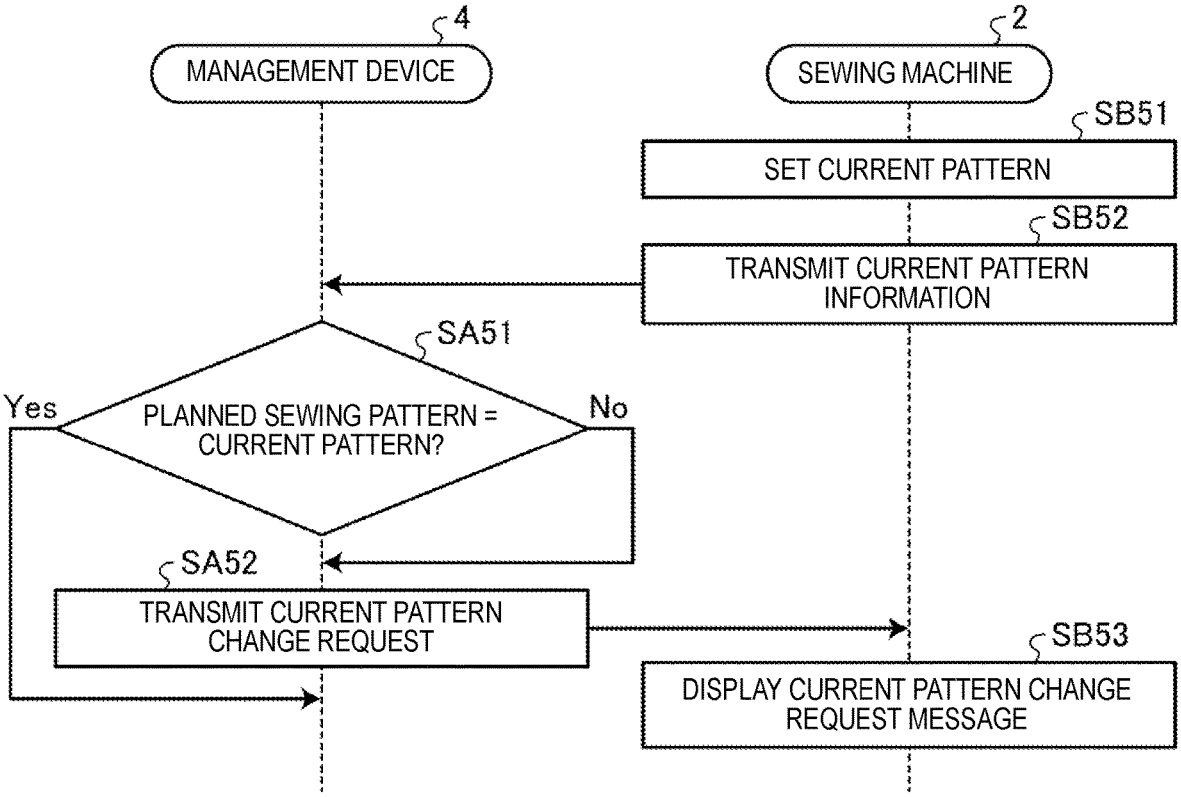
FIG. 7 is a flowchart showing another example of the operation of the sewing management system according to the present embodiment.

Regarding the processing in the flowchart of the fourth modification example shown in FIG. 7, description of the same processing as the processing in the flowchart of the embodiment shown in FIG. 3 will be omitted as appropriate, and different processing will be described. The processing of steps SA51 and SA52 shown in FIG. 7 is executed by the management device 4 based on the predetermined program and data. The processing of steps SB51, SB52, and SB53 is executed by the sewing machine 2 based on the predetermined program and data.

The operator Ma operates the input device 21 to set or change the current pattern on the sewing machine 2 on which the operator is working according to the process information. When the current pattern is newly set or changed based on the input from the input device 21, the arithmetic processing unit 29 of the sewing machine 2 performs processing of setting or changing the current pattern, and the current pattern information Dc stored in the storage unit 28 is updated (step SB51).

The arithmetic processing unit 29 outputs a control signal to the communication device 23 to transmit the current pattern information Dc, which is newly stored in the storage unit 28, to the management device 4. The current pattern information Dc is transmitted to the management device 4 by the communication device 23 (step SB52).

The processing of steps SA51, SA52, and SB53 is the same as the processing of steps SA12, SA 13, and SB12 in the embodiment shown in FIG. 3, and therefore the description thereof will be omitted.

Effects

As described above, according to the fourth modification example, when the sewing machine 2 receives an operation by the operator Ma to newly set or change the current pattern, the sewing machine 2 transmits the current pattern information Dc indicating the information on the newly set current pattern to the management device 4. Accordingly, it is possible to determine whether sewing is being performed with the correct sewing pattern each time.

Computer System

Figure 8:
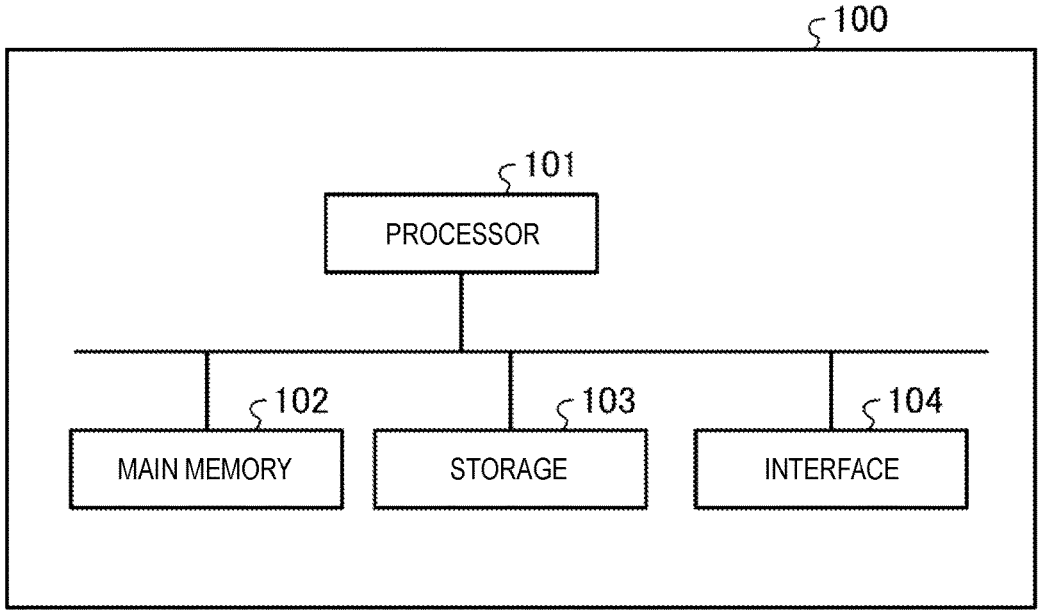
FIG. 8 is a block diagram showing a computer system 100 according to the present embodiment.

FIG. 8 is a block diagram showing a computer system 100 according to the present embodiment. The computer system 100 includes at least one of the sewing machine 2 and the management device 4 described above. The computer system 100 includes a processor 101 such as a CPU, a main memory 102 including a nonvolatile memory such as a ROM and a volatile memory such as a RAM, a storage 103, and an interface 104 including an input/output circuit. The functions of computer system 100 are stored in the storage 103 as computer programs. The computer programs include various application software for implementing the functions described above. The processor 101 reads a computer program from the storage 103, loads the computer program into the main memory 102, and executes the above-described processing according to the computer program. Computer programs may be distributed to the computer system 100 via a computer network.

According to the above-described embodiment, the computer program can execute acquisition of the current pattern information Dc indicating information on the current pattern of the sewing machine 2 from the plurality of sewing machines 2 that perform the pattern sewing with the current pattern, which is the set sewing pattern, and determination on whether the current pattern matches the planned sewing pattern.

Other Embodiments

Although the embodiment of the present application has been described above, the present invention is not limited to the contents of the embodiment. The embodiment and the modification examples described above can be combined as appropriate within a range that does not conflict with the processing contents. The above-described configuration elements include those that can be easily assumed by those skilled in the art, those that are substantially the same, and those that are in a so-called equivalent range. The above-described configuration elements can be combined as appropriate. Various omissions, substitutions, or changes of the configuration elements can be made without departing from the gist of the embodiments described above.

Among each of the processing described in the above embodiments, all or part of the processing described as being performed automatically can be performed manually, or all or part of the processing described as being performed manually can be performed automatically using known methods. Information including the processing procedures, specific names, and various data and parameters shown in the above documents and drawings may be changed freely, unless otherwise specified. For example, the various types of information shown in each drawing is not limited to the shown information.

Each configuration element of each device shown in the drawings is functionally conceptual, and does not necessarily need to be physically configured as shown in the drawings. In other words, the specific form of distributing and integrating each device is not limited to those shown in the drawing, and all or part of the devices can be functionally or physically distributed or integrated in any unit depending on various loads, usage conditions, and the like. For example, the above-described management device 4 may be configured by a plurality of computers divided into several functions, and some functions of the computers may be performed using a cloud server that executes various functions in the form of cloud computing.

The invention claimed is:

1. A sewing management system comprising:

a plurality of sewing machines configured to perform pattern sewing with a current pattern, which is a set sewing pattern; and a management device configured to acquire current pattern information indicating information on the current pattern of each sewing machine of the plurality of sewing machines, and configured to determine whether the current pattern matches a planned sewing pattern, wherein when it is determined that the current pattern of a sewing machine of the plurality of sewing machines is different from the planned sewing pattern, the management device transmits, to the sewing machine of the plurality of sewing machines, a request based on the current pattern of the sewing machine being different from the planned sewing pattern, the sewing machine of the plurality of sewing machines includes a display device that displays predetermined display data, and the sewing machine of the plurality of sewing machines displays a request message when the request is acquired.

2. The sewing management system according to claim 1, wherein each sewing machine of the plurality of sewing machines transmits operation status information indicating an operation status of the respective sewing machine to the management device at a predetermined cycle, and the management device specifies the planned sewing pattern based on process information including information on a sewing pattern of the pattern sewing to be executed by the respective sewing machine and the operation status of the respective sewing machine.

3. The sewing management system according to claim 1, wherein the management device transmits, to each sewing machine of the plurality of sewing machines, a current pattern information request for requesting current pattern information of the respective sewing machine at a predetermined cycle, and each sewing machine of the plurality of sewing machines transmits the current pattern information to the management device when the current pattern information request is acquired.

4. The sewing management system according to claim 1, wherein each sewing machine of the plurality of sewing machines transmits the current pattern information to the management device when an operation to set the current pattern is received.

5. The sewing management system according to claim 1, wherein when it is determined that the current pattern of the sewing machine of the plurality of sewing machines is different from the planned sewing pattern, the management device transmits, to the sewing machine of the plurality of sewing machines, a current pattern change request for requesting to change the current pattern to the planned sewing pattern.

6. The sewing management system according to claim 5, wherein the sewing machine of the plurality of sewing machines displays a change request message indicating that the current pattern change is requested on the display device when the current pattern change request is acquired.

7. The sewing management system according to claim 5, wherein the sewing machine of the plurality of sewing machines changes the set current pattern to the planned sewing pattern when the current pattern change request is acquired, and the sewing machine of the plurality of sewing machines displays a change result message indicating that the current pattern is changed on the display device.

8. The sewing management system according to claim 1, wherein when it is determined that the current pattern of a sewing machine of the plurality of sewing machines is different from the planned sewing pattern, the management device transmits, to the sewing machine of the plurality of sewing machines, a sewing prohibition request for requesting to prohibit sewing with the current pattern.

9. The sewing management system according to claim 8, wherein the sewing machine of the plurality of sewing machines displays a prohibition request message indicating that prohibition of the sewing with the current pattern is requested on the display device when the sewing prohibition request is acquired.

10. The sewing management system according to claim 8, wherein the sewing machine of the plurality of sewing machines stops the sewing with the current pattern when the sewing prohibition request is acquired, and the sewing machine of the plurality of sewing machines displays a stop result message indicating that the sewing with the current pattern is stopped on the display device.

* * * * *